United States Patent [19]

Bianchi

[11] 4,079,681

[45] Mar. 21, 1978

[54] DEVICE FOR THE INSERTION OF THE POCKET STRIP APPLIED TO SEWING MACHINES FOR MAKING WELTED POCKETS

[75] Inventor: Nereo Bianchi, Pavia, Italy

[73] Assignee: NECCHI, Societa per Azioni, Pavia, Italy

[21] Appl. No.: 721,230

[22] Filed: Sep. 8, 1976

[30] Foreign Application Priority Data

Oct. 3, 1975 Italy ..... 42906

[51] Int. Cl.[2] ..... D05C 9/04

[52] U.S. Cl. ..... 112/121.15

[58] Field of Search ..... 112/121.5, 65, 68, 70, 112/76, 264, 147

[56] References Cited

U.S. PATENT DOCUMENTS

| | | | |
|---|---|---|---|
| 3,296,986 | 1/1967 | Gansl | 112/147 X |
| 3,930,453 | 1/1976 | Hintzen et al. | 112/68 |
| 3,980,030 | 9/1976 | Fischer et al. | 112/121.15 |

*Primary Examiner*—Werner H. Schroeder
*Assistant Examiner*—Peter Nerbun
*Attorney, Agent, or Firm*—Stevens, Davis, Miller & Mosher

[57] ABSTRACT

A device for the insertion of a pocket strip applied to sewing machines for making welted pockets which includes a truck for feeding fabric, a work clamp composed of two distinct elements operated independently, two side pressers, a central blade, a mounting frame, a pneumatic motor to drive the frame toward and away from the pressers, a pocket strip clamp for a pocket strip carried by the mounting frame and adapted to make relative thereto alternate displacements, a pneumatic cylinder fixed to the mounting frame to drive the pocket strip clamp, a frame carried by the mounting frame to prepare and guide a pocket strip free edge projecting from the pocket strip clamp carrying it in such a way as to facilitate the invention of the pocket strip on patch fabric forming the welted pocket.

1 Claim, 5 Drawing Figures

FIG. 2
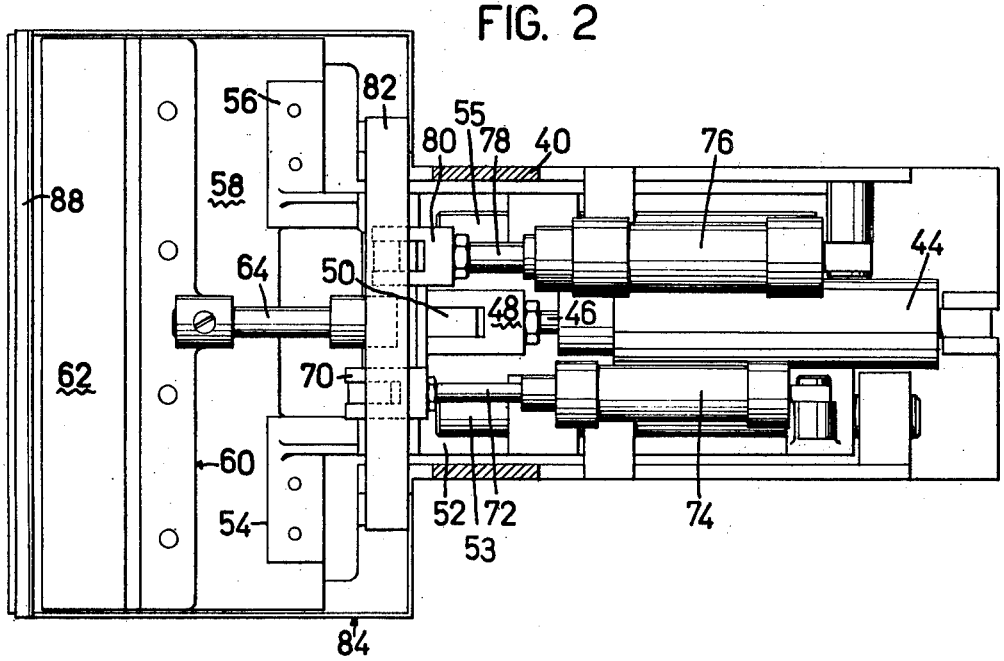
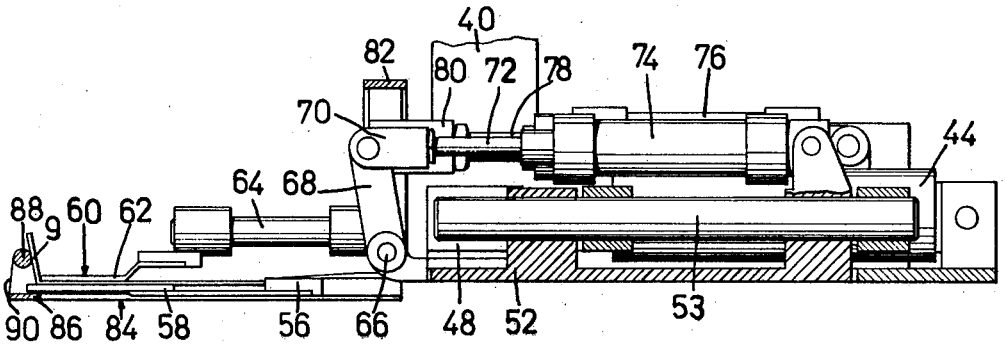
FIG. 3

DEVICE FOR THE INSERTION OF THE POCKET STRIP APPLIED TO SEWING MACHINES FOR MAKING WELTED POCKETS

The present invention relates to a device for the insertion of the pocket strip applied to sewing machines for making welted pockets.

The device relates more precisely to that type of sewing machine for producing welted pockets wherein the patch fabric forming the pocket is superimposed on the garment to be worked directly on the machine and not on a separate frame. The insertion of the pocket strip is made together with the preliminary operations of folding and shaping made on the patch fabric in the production of pockets without pocket strip, according to a known technique described in detail in U.S. Pat. No. 3,653,345. It is an object of the present invention to eliminate the manual operation of inserting the pocket strip with a consequent saving of time, while maintaining the same precision obtainable with the manual operation.

The technical problem to be solved to attain the object of the present invention was to provide a device for the insertion of the pocket strip suitable to work with the shaping members of the machine in such a way as to avoid, during the inserting operation, the harmful movements of relative sliding among the various fabrics to be sewn together to obtain the pocket.

The solution of the technical problem is characterized in that the device is formed by a mounting frame, operated by a pneumatic motor, suitable to approach and depart from the pressers, a pocket strip clamp for the pocket strip carried by the mounting frame and adapted to make relative thereto alternate displacements driven by a pneumatic cylinder fixed to the mounting frame, a frame carried by the mounting frame to prepare and guide the pocket strip free edge projecting from the pocket strip clamp carrying the same in such a way as to facilitate the insertion of the pocket strip on the patch fabric forming the welted pocket. Further advantages and characteristics will be apparent from the following description of a preferred embodiment of the device of the present invention and the accompanying drawings in which:

FIG. 2 is a plan view of said device;

FIG. 3 is a side sectional view of FIG. 2; and

Figure 4:
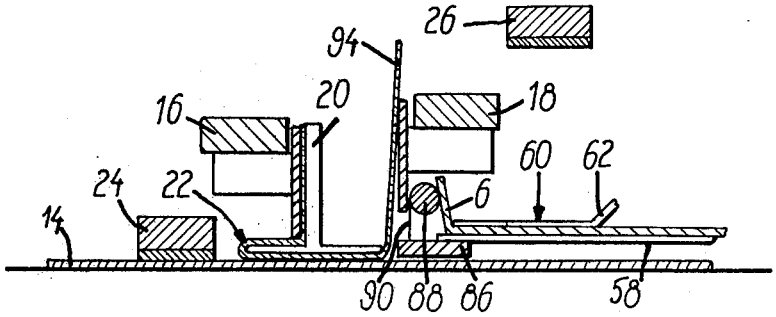
Figure 5:
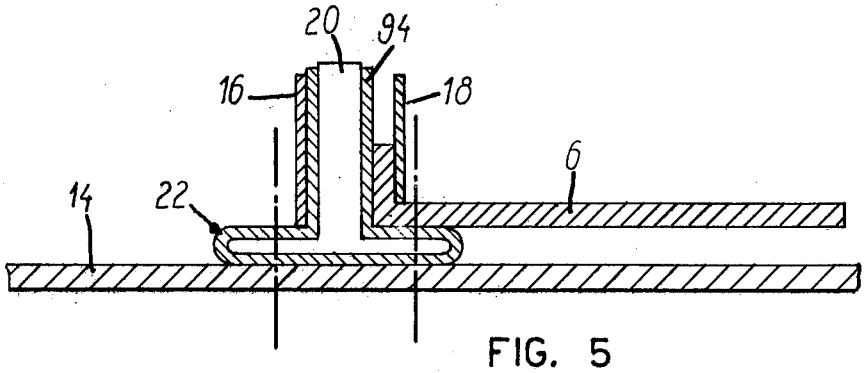

FIGS. 4 and 5 schematically show two following phases of the pocket strip insertion operation.

Figure 1:
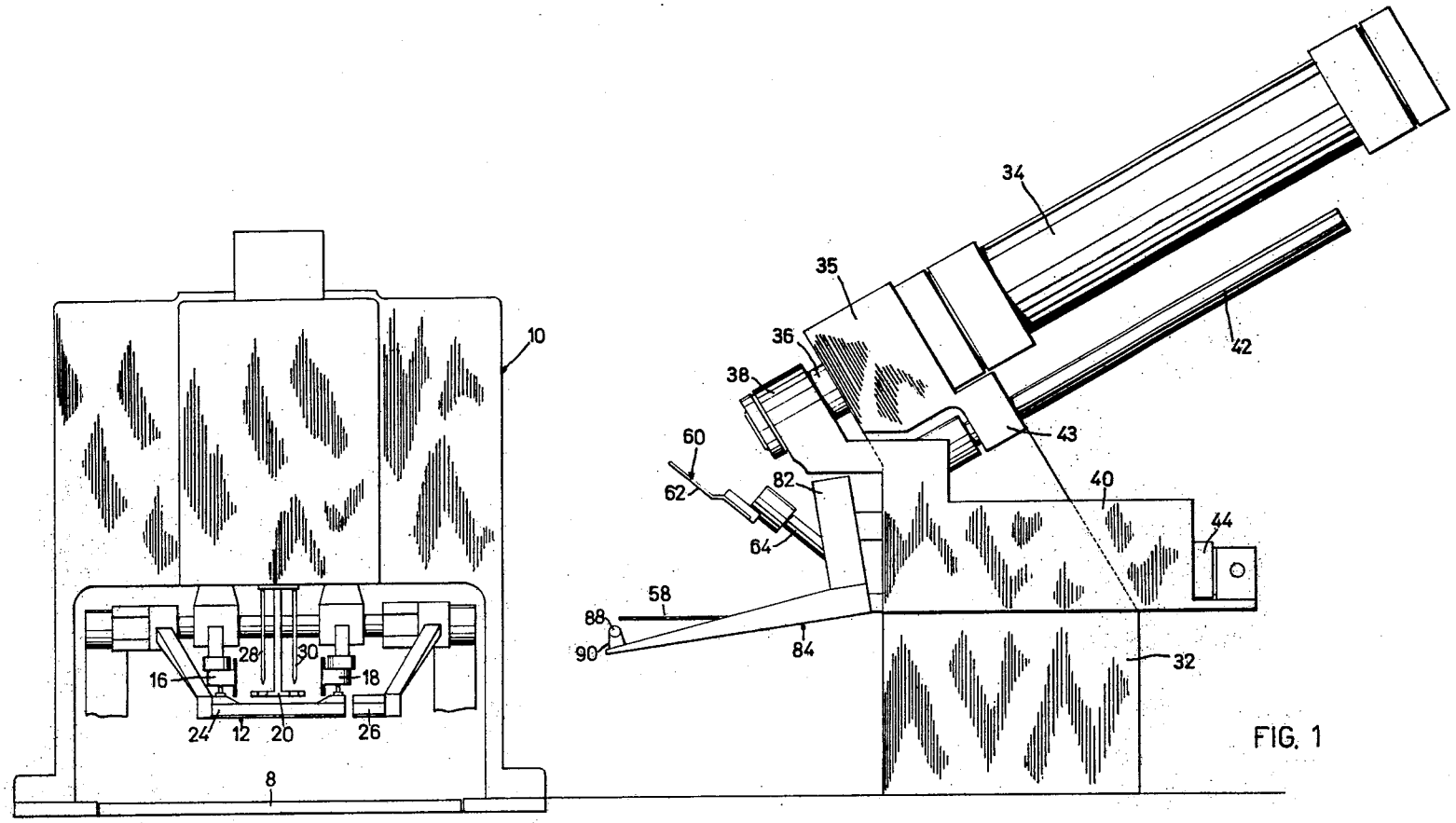
FIG. 1 is a complete view of the device of the invention and of the sewing machine to which the device is applied.

With reference to FIG. 1 a sewing machine is provided with numeral 10 suitable to make pockets of the welted type onto coats and trousers.

A sewing machine of such type has been described in detail in U.S. Pat. No. 3,653,345 mentioned above. Considering its employment in connection with the object of the present invention, it is useful to point out some of its portions modified according to the particular appliance. Reference is made to work clamp 12 wherein under workpiece 14 is fixed and side pressers 16 and 18 which, together with central blade 20, give the suitable shape to the patch fabric 22 before the beginning of the pocket forming operation. In order to cooperate with the device of the invention, work clamp 12 is formed by two distinct portions 24 and 26 receiving independent drives so that when portion 24 is caused to go down to press the fabric, portion 26 can stay in its raised position.

Also the two side pressers 16 and 18 are actuated independently to allow them to make, in following times, their maneuver, as will be explained hereinafter. Sewing machine 10 is provided with a needle bar carrying two needles 28 and 30 and a cutter device not shown to cut the fabric parallely and between the two stitching lines.

The device for the pocket strip introduction is placed sideways to the sewing machine 10 and is journaled by a column 32 fixed, in turn, to the same sewing machine mounting table. It is formed by a pneumatic cylinder 34 fixed, slanted downward, to column 32 by means of collar 35. At the free end of rod 36 of said cylinder, through a second collar 38, a mounting frame 40 and a cylindrical rod 42 are fixed. Rod 42 slides in a seat made from board 43 fastened to column 32 having mainly a guiding function for mounting frame 40 operated by cylinder 34. Operating members are placed on mounting frame 40 as are members driven thereby in order to obtain, according to the invention, the insertion of the pocket strip 6 (FIG. 4) on the pocket patch fabric. Cylinder 44 is fixed to the central portion of mounting frame 40. Rod 46 of cylinder 44 is connected, through conjunction member 48, to projection 50 of plate 52 with complicated shape, mounted to slide axially on cylindrical guides 53 and 55 fixed to mounting frame 40. Plate 52 carries in its front part (FIG. 2) two end portions 54 and 56. Lower portion 58 of pocket strip clamp 60 (FIGS. 2 and 3) is connected to end portions 54 and 56.

Portion 62 of clamp 60 is secured to rod 64, which, in turn, at the opposite end is fixed to a pin 66 free to rotate in suitable seats formed in the walls of the two end portions 54 and 56.

A rod 68 (FIG. 3) also is fixed to pin 66 and is connected at the upper end, through a pivot, to connecting member 70 fixed at the end of rod 72 of pneumatic cylinder 74 fastened at the other end of plate 52. Cylinder 74 and members 68, 64, 62, operating therefrom, are therefore movable with plate 52 when cylinder 44 is actuated. Fixed to mounting frame 40 is a third cylinder 76 whose rod 78 is connected, through junction means 80, to the upper portion 82 of an L-shaped frame 84 having, at its lower free end 86, an opening delimited by an upper bar 88 and side walls 90.

Work clamp 60, placed directly above lower portion 86 of frame 84, can move inside the opening.

The stages of the operating cycle of the device described take place in the way described hereinafter.

The operator loads workpiece 14 (FIGS. 4 and 5), whereon the pocket has to be sewn, onto truck 8 when it is in its position of working cycle end stroke and left and right portions 24 and 26 of work clamp 12 are raised (FIG. 1).

Then the operator lowers both the left and right portions 24 and 26 of work clamp 12 and displaces truck 8 and work clamp 12 to their rear position corresponding to the pocket strip loading position and for the beginning of the sewing cycle.

At this point the operator positions the patch fabric 22 (FIGS. 4 and 5) and then drives the lowering of central blade 20, the closing of left side presser 16 and the raising of right portion 26 of work clamp 12. Now the pocket strip loader is operated. Pocket strip 6 is already positioned in its clamp and has an extreme edge projecting from the clamp and folded upward, resting upwardly against bar 88 of frame 84.

Rod 36 of cylinder 34 makes its downward stroke and carries mounting frame 40 and pocket strip clamp 60 to the position shown in FIG. 4. Cylinder 44 is then automatically actuated and provides for the advance of clamp 60 with pocket strip 6. The raised edge of pocket strip 6 is forced to fold in order to overlap on its remaining portion to enter into a slot defined in FIG. 3 by bar 88 and by end 86 of frame 84. Therefore this end portion places itself against right vertical edge 94 of patch fabric 22.

In this movement the blade of right side presser 18 closes and the pocket strip together with the patch fabric are pressed against the vertical wall of central blade 20.

Now piston road 46 of cylinder 44 and frame 84, come back causing the lowering of right portion 26 of work clamp 12. Afterwards the sewing cycle begins and pocket strip 6 is sewn together with patch fabric to the garment to obtain a welted pocket.

What is claimed is:

1. In a device for the insertion of a pocket strip applied to sewing machines for making welted pockets comprising a truck for feeding fabric, a work clamp composed of two distinct elements operated independently, two side pressers, right and left, and a central blade, the improvement comprising a mounting frame, a pneumatic motor to drive said frame, toward and away from said pressers, a pocket strip clamp for a pocket strip carried by said mounting frame and adapted to make relative thereto alternate displacements, a first pneumatic cylinder fixed to said mounting frame to drive said pocket strip clamp, a movable frame carried by said mounting frame positionable against a pocket strip free edge projecting from said pocket strip clamp carrying said pocket strip, pins carried by said frame, a second pneumatic cylinder to operate said pocket strip clamp and to pivot said pocket strip clamp around said pins, said work pocket strip clamp being at one end, placed in correspondence with the free edge of the pocket strip, a slot defined by an upper bar and by two vertical walls rising from said frame, said bar folding upwardly a pocket strip free edge and placing it in correspondence with said slot, said pocket strip free edge being subsequently pushed through said slot by said pocket strip clamp and actuation of said first pneumatic cylinder in order to be placed against a patch fabric vertical portion resting on said central blade.

* * * * *